United States Patent [19]

Orr

[11] 4,230,233

[45] Oct. 28, 1980

[54] END PANEL FOR CARTON

[75] Inventor: Robert P. Orr, Tiburon, Calif.

[73] Assignee: Bendix Forest Products Corporation, San Francisco, Calif.

[21] Appl. No.: 958,292

[22] Filed: Nov. 6, 1978

[51] Int. Cl.[3] ..... B65D 5/12; B65D 8/18

[52] U.S. Cl. ..... 217/36; 217/52; 229/23 R; 229/23 C

[58] Field of Search ..... 217/36, 52; 229/23 R, 229/23 C

[56] References Cited

U.S. PATENT DOCUMENTS

| | | | |
|---|---|---|---|
| 3,905,478 | 9/1975 | Peterson | 217/52 |
| 3,935,990 | 2/1976 | Crane | 220/23 R |
| 3,997,074 | 12/1976 | Shead | 220/21 |
| 4,147,289 | 4/1979 | Crane | 229/23 R |

*Primary Examiner*—George E. Lowrance
*Attorney, Agent, or Firm*—Robert C. Smith; William F. Thornton

[57] ABSTRACT

A molded plastic carton end includes a thin face panel reinforced by molded ribs and bounded on four sides by rim sections each comprising a plurality of parallel walls abutting against a face member with closely spaced cross members to add additional stiffness and resistance to crushing. The multiple walls also provide a plurality of parallel layers to receive and hold nails for attaching side, top and bottom members to complete the carton. The walls intersect at the corners, thus forming a large number of individual box sections at each corner, making the corners of the carton end very resistant to deformation. A number of plastic materials and fillers may be used including polyethylene filled with wood and/or a limited amount of a blowing agent.

9 Claims, 5 Drawing Figures

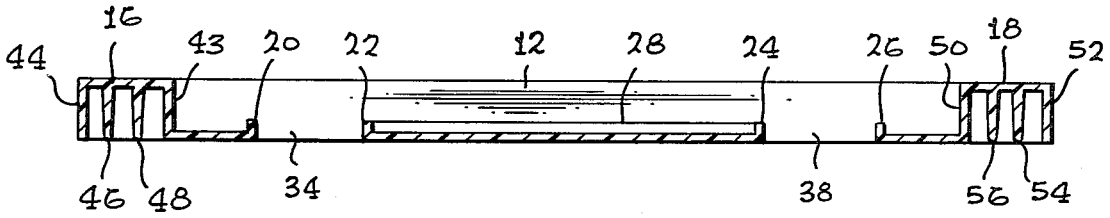
FIG. 2
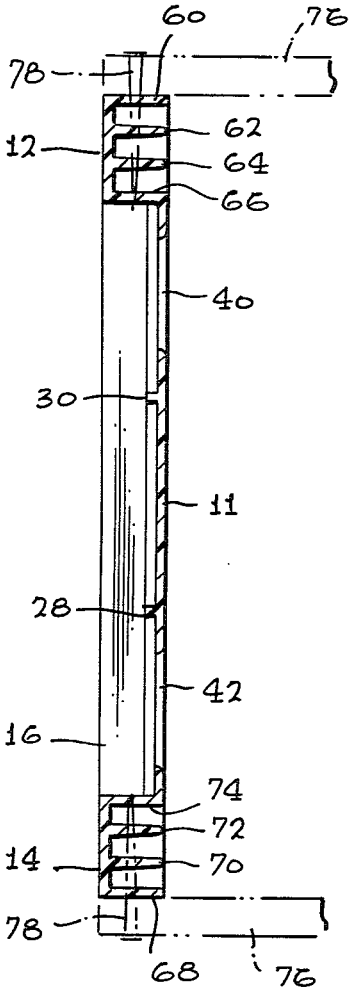
FIG. 4
FIG. 5
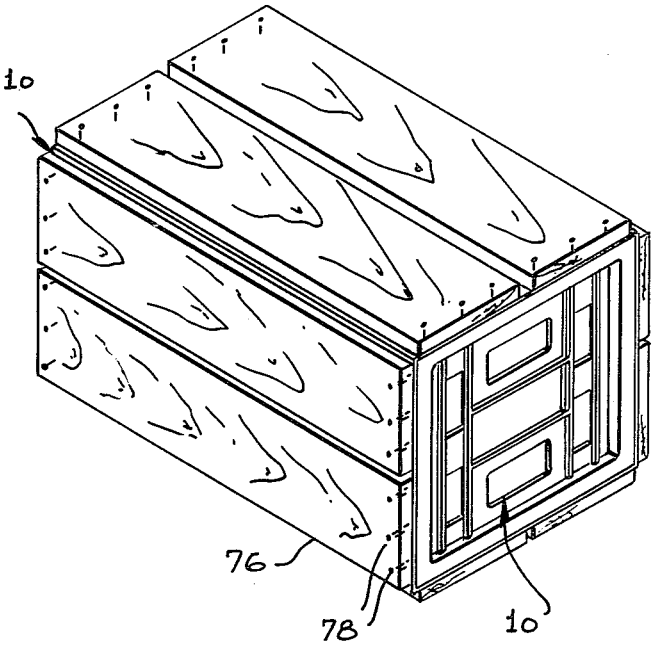

END PANEL FOR CARTON

BACKGROUND OF THE INVENTION

Containers or cartons for the packaging and shipping of fruit are, or may be, subjected to substantial crushing loads because they are frequently stacked many cartons high. They may also be exposed to a highly humid environment to keep the contained fruit from drying out. The cartons may be kept in this humid environment for a period of months. A common corrugated paper box which may be used for this purpose has limited compressive strength, and this is severely reduced from exposure to high humidity. One technique which has been used to attempt to overcome this shortcoming is to form the end panels of the carton with three or four layers of corrugated paper. This will withstand the humid environment for a period, but such cartons, if loaded with several others on top, will ultimately crush, allowing their contents to be crushed, also. Since the traditional end panels of wood about 7/8 inch thick have become quite expensive, other materials have been investigated and tried with varying degrees of success. A carton end formed of a shell of high density plastic such as polystyrene filled with and bonded to a low-density expanded plastic material has achieved a limited degree of success, but recent increases in the cost of the plastic materials have made such panels uncompetitive with wood, at least for some applications. This structure appears in U.S. Pat. No. 3,905,478 filed in the name of Dale S. Peterson et al and assigned to the assignee of the present application. Other attempts to use some of the least expensive plastic materials have resulted in carton ends which have too much material in them, in which case they are too expensive, or they have been made with less material, frequently becoming too fragile in the process and proving to be unsuitable for the intended application.

DESCRIPTION OF THE DRAWINGS

FIG. 2 is a sectional view taken along line 2—2 of FIG. 1;

FIG. 4 is a sectional view taken along line 4—4 of FIG. 3;

FIG. 5 is a perspective view of a typical fruit carton incorporating the carton ends of FIGS. 1-4.

DESCRIPTION OF THE PREFERRED EMBODIMENT

Figure 1:
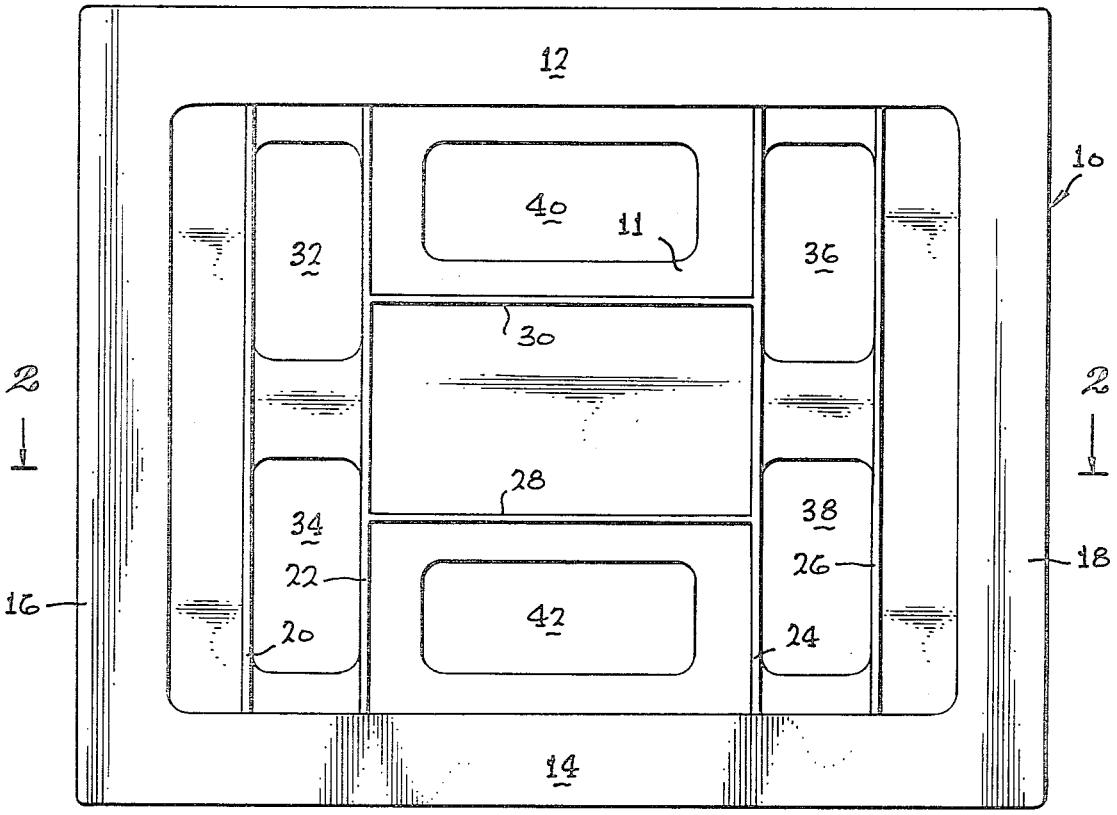
FIG. 1 is a plan view of a carton end made according to my invention.

FIG. 1 shows a plan view of a carton end as seen from the outside of the carton. The carton end 10 consists of a face panel 11 which is molded together with a top rim section 12, a bottom rim section 14, and side rim sections 16 and 18. The molded material may be of polypropylene filled with any of many kinds of fillers such as sawdust, paper, nut shells, etc. in which case the filler material may be up to 25% by volume of the total. Another useful material is polystyrene which, however, can only accept a smaller percentage of filler if it is not to be excessively weakened. These plastic materials may also be filled with a plastic blowing agent which creates small air bubbles. Applicant has recently determined that a satisfactory formulation which is quite economical includes a 55%–45% ratio by weight of #2 sawdust which is graded after a hammer and screening process and polypropylene which may be purchased of a grade not meeting normal specifications, particularly as to color. Pigments may be added to achieve a desirable color, as may inhibitors such as ultraviolet inhibitors to prevent premature deterioration from outdoor storage. A plurality of vertical ribs 20, 22, 24 and 26 extend between top rim section 12 and bottom rim section 14. A pair of short horizontal ribs 28 and 30 are molded between vertical ribs 22 and 24 in such manner as to define a centrally disposed rectangle for receiving a label. A plurality of openings are formed in face panel 11 for ventilation. Between ribs 20 and 22 are openings 32 and 34; between ribs 24 and 26 are openings 36 and 38, and between ribs 22 and 24 are openings 40 and 42. The sizes of these openings are chosen appropriate to the contents. In an end panel whose outside dimensions are 13″×10.5″, the openings shown are appropriate for cantaloupe. Other sizes and configurations may be used for other kinds of fruit.

FIG. 2 is a sectional view taken along line 2—2 of FIG. 1. In this view the face panel 11 is seen to be located along the inside edge of the rim sections. The narrower ribs 20, 22, 24 and 26 extend toward the outside of the panel, as installed. This sectional view is taken through opening 34, and it will be observed that the edges of this opening are rounded to avoid scraping, cutting or otherwise damaging any fruit with which it may come in contact. The side rim section 16, in addition to the inside wall 43 and outside wall 44, also includes two parallel internal walls 46 and 48. Similarly, side rim section 18 includes an inside wall 50, an outside wall 52 and parallel internal walls 54 and 56.

Figure 3:
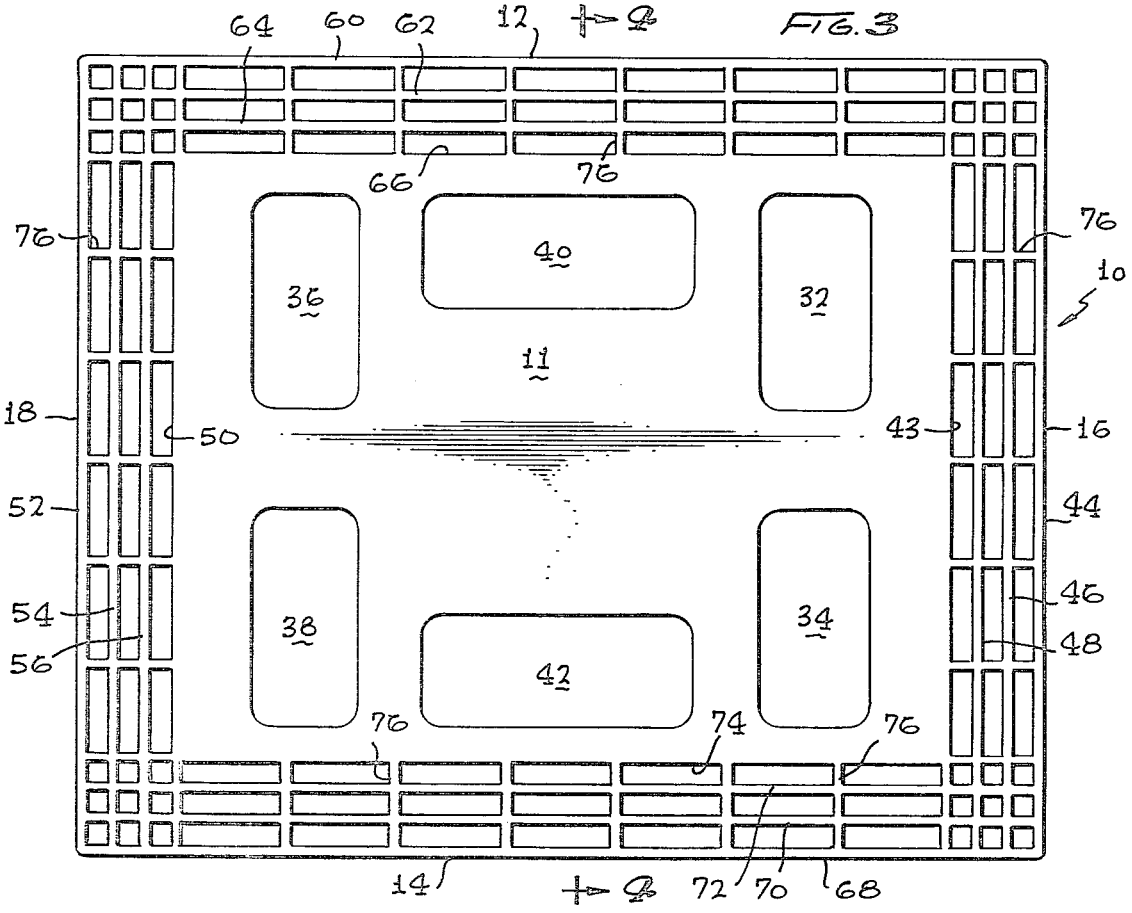
FIG. 3 is a view of the carton end of FIG. 1 as seen from the rear or inside.

FIG. 3 is a plan view of my carton end 10 as seen from the back. In this view the side rim sections 16 and 18 are shown with walls 43, 44, 46, 48 and 50, 52, 54, 56, respectively, as described above. Similarly, top rim section 12 includes an outside wall 60, internal parallel walls 62 and 64, and an inside wall 66, and bottom rim section 14 includes an outside wall 68, internal parallel walls 70 and 72, and an inside wall 74. All of the walls in the side rim sections extend the entire distance from top to bottom of the carton end, and all of the walls in the top and bottom rim sections extend the entire width of the carton end, thus causing each of the walls of the side rim sections to intersect with each wall of the top and bottom rim sections to thereby produce a plurality of box sections forming very strong, well-reinforced corners. To further strengthen the rim sections, a plurality of cross members 76 extend between the parallel walls to inhibit their buckling or distorting under compressive or side loads. With a carton end 10 of the dimensions described above, a quite strong and rigid structure results from using five cross members in the side rim sections and six in the top and bottom rim sections since that reduces the maximum span between such cross members to about 1.4 inches. Some additional resistance to crushing is provided by the face panel 10 and associated ribs 20, 22, 24, 26, 28 and 30, although these ribs serve primarily to keep the face plate from being too flexible.

FIG. 4 is a vertical section taken through FIG. 3 showing top and bottom rim sections 12 and 14 with parallel walls 60, 62, 64 and 66 in rim section 12 and walls 68, 70, 72 and 74 in rim section 14. Also shown is face panel 11 with openings 40 and 42 which are rounded on the edges to avoid damaging the contents of the carton. In this section the short horizontal ribs 28 and 30 are also shown.

FIG. 5 is a perspective view of a carton incorporating two of the above described carton ends. The ends 10 have a wrap 76 consisting of a bottom, sides and top flaps which wrap may be of TKV, a Kraft paper-coated wood veneer, or of separate wood boards. This wrap is nailed to the rim sections by means of nails 78 as shown, and the top flaps are folded over and nailed to the top rim sections in such manner as to, preferably, leave a space of approximately an inch to aid air circulation. Corrugated paper may also be used and in such case may preferably be cemented to the edges of the ends 10.

The structure described has considerable resistance to crushing and uses a limited amount of plastic material in proportion to its strength. With four walls and the cross members shown, there will be an adequate structure for holding nails since the nails will normally penetrate three of such walls, which hold them securely. The pattern of openings in the face panel is subject to variation depending upon the contents, whether one or some of the openings are used for hand holds, the size of label desired, etc. Similarly, while the pattern of short vertical and horizontal ribs shown is quite economical and adds sufficient stiffness to the face panel, more ribs or deeper ribs may be used at a small cost in material if more stiffness is desired, or fewer ribs if it is desired to use even less material.

What is claimed is:

1. In a container having top, bottom and side panels:

a pair of end panels to which said top, bottom and side panels are fastened, each said end panel comprising a molded frame of high density plastic, said frame including a face panel of area significantly more than half of the area of said end panel, top, bottom and side rim sections attached around the periphery of said face panel and of a depth equal to the desired thickness of said end panel, said face panel being attached to the inside edges of said rim sections, a plurality of ribs extending across said face panel between at least two of said rim sections, each of said side rim sections comprising an inside wall extending the entire height of said end panel, an outside wall, a plurality of internal walls spaced between and parallel to said inside and outside walls extending the entire height of said end panel and a plurality of reinforcing cross members extending between said inside wall and said outside wall, each of said top and bottom rim sections comprising an inside wall extending the entire width of said end panel, an outside wall intersecting the outside walls of said side rim sections, a plurality of internal walls spaced between and parallel to said inside and outside walls of said top and bottom rim sections and extending the entire width of said top and bottom panels and a plurality of reinforcing cross members extending between said inside and outside walls, said face panel being attached to and framed by adjoining internal edges of said inside walls of said top, bottom and side rim sections.

2. A container as claimed in claim 1 wherein said face panel includes a plurality of openings.

3. A container as claimed in claim 2 wherein the inside edges of said openings are rounded to avoid damaging the contents of said container.

4. A container as claimed in claim 1 wherein said inside walls, said internal walls and said outside walls of said side rim sections intersect and support the inside walls, internal walls and outside walls of said top and bottom rim sections.

5. A container as claimed in claim 2 wherein said ribs extending across said face panel include a plurality of vertical ribs extending between said top and bottom rim sections.

6. A container as claimed in claim 1 wherein the edges of said outside walls, said internal walls and said inside walls are open toward the inside of said container and covered with a facing toward the outside of said container.

7. A container as claimed in claim 1 wherein said high density plastic comprises polyethylene filled with paper.

8. A container as claimed in claim 1 wherein said high density plastic comprises polyethylene filled with wood sawdust.

9. A container as claimed in claim 1 wherein said high density plastic comprises polystyrene.

* * * * *